US006357803B1

(12) United States Patent
Lorek

(10) Patent No.: US 6,357,803 B1
(45) Date of Patent: Mar. 19, 2002

(54) SECURITY LOCK, FOR DOORS IN INSTALLATION/MOUNTING IN CARAVANS IN PARTICULAR

(75) Inventor: Manfred Lorek, Siegen (DE)

(73) Assignee: Electrolux Siegen GmbH, Siegen (DE)

( * ) Notice: Subject to any disclaimer, the term of this patent is extended or adjusted under 35 U.S.C. 154(b) by 0 days.

(21) Appl. No.: 09/521,789

(22) Filed: Mar. 9, 2000

(30) Foreign Application Priority Data

Mar. 10, 1999 (DE) ..... 119 10 564

(51) Int. Cl.[7] ..... E05C 19/10

(52) U.S. Cl. ..... 292/99; 49/364; 292/341.17; 292/124

(58) Field of Search ..... 292/DIG. 4, 46, 292/124, 121, 122, 126, 238, 95, 96, 99, 128, 198, 219, 220, 254, 322, 341.15, 341.17; 49/322, 364, 379, 394, 395, 449, 503

(56) References Cited

U.S. PATENT DOCUMENTS

| | | | | |
|---|---|---|---|---|
| 836,810 A | | 11/1906 | Kapus | |
| 1,639,878 A | * | 8/1927 | Bentott | 292/99 |
| 2,028,954 A | * | 1/1936 | Roedding | 292/126 |
| 2,115,947 A | | 5/1938 | Ellison | |
| 2,197,195 A | | 4/1940 | Schemers | |
| 3,266,830 A | | 8/1966 | Appleberry | |
| 3,451,702 A | * | 6/1969 | Little | 292/99 |
| 4,647,088 A | * | 3/1987 | Nelson | 292/136 |
| 6,000,734 A | * | 12/1999 | Prevot | 292/99 |

FOREIGN PATENT DOCUMENTS

| | | |
|---|---|---|
| SE | 133 455 | 10/1951 |

* cited by examiner

*Primary Examiner*—Anthony Knight
*Assistant Examiner*—André L. Jackson
(74) *Attorney, Agent, or Firm*—Pearne & Gordon LLP

(57) ABSTRACT

In a security lock, for doors of furniture in particular, like e.g. built-in furniture in caravans, which are exposed to substantial forces in case of accidents, an engagement part 2 of a spring-charged pivotable bolt 5 is provided for which with a head part 8 in case of interlocking interlocks in a recess 9 of a receiving member 4. Interlocking takes place between a housing-integrated bordering wall 10 of said recess 9 and a cam 12 pivotably supported in said receiving member 4. Said cam 12 comprises diametrically opposed end sections 13, 14 of which the free end section 13 not facing said head part 8 of said bolt 5 can cooperate with a pin member 15 provided for on said engagement part 2. Said pin member in case of intended unlocking presses on said free end section 13 of said cam 12, whereby said end section 14 being in contact with said head part 8 of said bolt 5 in the manner of two inclined planes 16, 17 sliding one on the other, of said cam 12 pivots said head part 8 of said bolt 5 into an unlocked position.

10 Claims, 1 Drawing Sheet

SECURITY LOCK, FOR DOORS IN INSTALLATION/MOUNTING IN CARAVANS IN PARTICULAR

This application claims priority from German Application No. 11910564.2. filed Mar. 10, 1999.

BACKGROUND OF THE INVENTION

In lockable installations, in caravans in particular, it turned out that during driving those may be subjected to great forces which frequently are caused by severe braking of the caravan, by bad road topping or last not least by an accident. Such forces, however, may cause the doors of the installations in the respective caravan to burst open and then the entire content of the cupboard to fall out, this casing much irritation with the driver of the caravan, and/or maybe to hurt the persons in the caravan in case of an accident.

There are already existing a plurality of door locks and door latches which in principal consideration very well installations in caravans can be closed or locked. However, for this field of application door locks include the disadvantage of use of a key which frequently is lost in camping life and then one stands in front of a closed cupboard door or one at all forgets closing so that the danger of bursting open of the respective door in case of severe vibration still exists.

Simple lockings, however, can loosen in case of concussion or it may be forgotten to insert them, this thus not representing a satisfactory solution.

SUMMARY OF THE INVENTION

Here, the invention comes into action which is based on the object of proposing a security lock of simple construction, for closing installations/mountings in caravans in particular, which automatically locks when e.g. a door is closed and which then can be unlocked or opened, respectively, without key and without much fuzz, wherein it must be guaranteed simultaneously that the locking does not unlock by self-action in case of severe concussions.

In accordance with the present invention the object is solved in simple manner by the features contained in the characterizing clause of claim 1, preferred embodiments being characterized by the features in the respective subclaims.

By the measurement of e.g. providing a hook-shaped bolt which bolt is supported pivotably against spring force, on one side of the door and arranging a housing-integrated recess on the other side of the door frame, it is advantageously achieved that the head part of the hook-shaped bolt in case of locking interlocks into the recess in clockwise direction and thus the door automatically closes and/or is held in closed condition, respectively, namely without any key being required, when the door is pushed to close or is slammed. Of course, it also is conceivable that the locking member is provided for at the piece of furniture, e.g. a refrigerator housing, and the recess is provided for in the door.

For opening the door again on the side of the door frame a pivotably supported cam with diametrically opposing end sections is provided for, of which the free end section not facing the head part of the bolt cooperates with a pin member provided for on the door such that it then for intended unlocking presses on the free end section of the cam and thereby the hook-shaped bolt again springs out of its interlocking position when person simply presses against the door from outside. This is possible because the pin member charges the cam on its lower end section and thereby the upper end section of the cam pivots the head part of the bolt through two inclined planes sliding on one another in counterclockwise direction into its unlocked position.

In a preferred embodiment of the security lock in accordance with the present invention it is provided for that at least one element comprimable against a resilient force is provided for between the door and the door frame, which element can be compressed in locking direction against spring force and thereby exerts a pressing force onto the hook-shaped bolt in its interlocking position in the area of its engaging surface.

In connection with a security lock, e.g. in a refrigerator, sealing of the refrigerator door can serve as comprimable element which cooperates with a complementary sealing surface at the refrigerator housing. For a simple cupboard door, however, it can be sufficient if a stop pin cooperating with a pressure spring is provided for as comprimable element.

BRIEF DESCRIPTION OF DRAWINGS

Further details and advantages of the invention in the following will be explained and described in more detail by an embodiment with reference to the attached drawing. In the drawing

DETAILED DESCRIPTION OF PREFERRED EMBODIMENT

Figure 1:
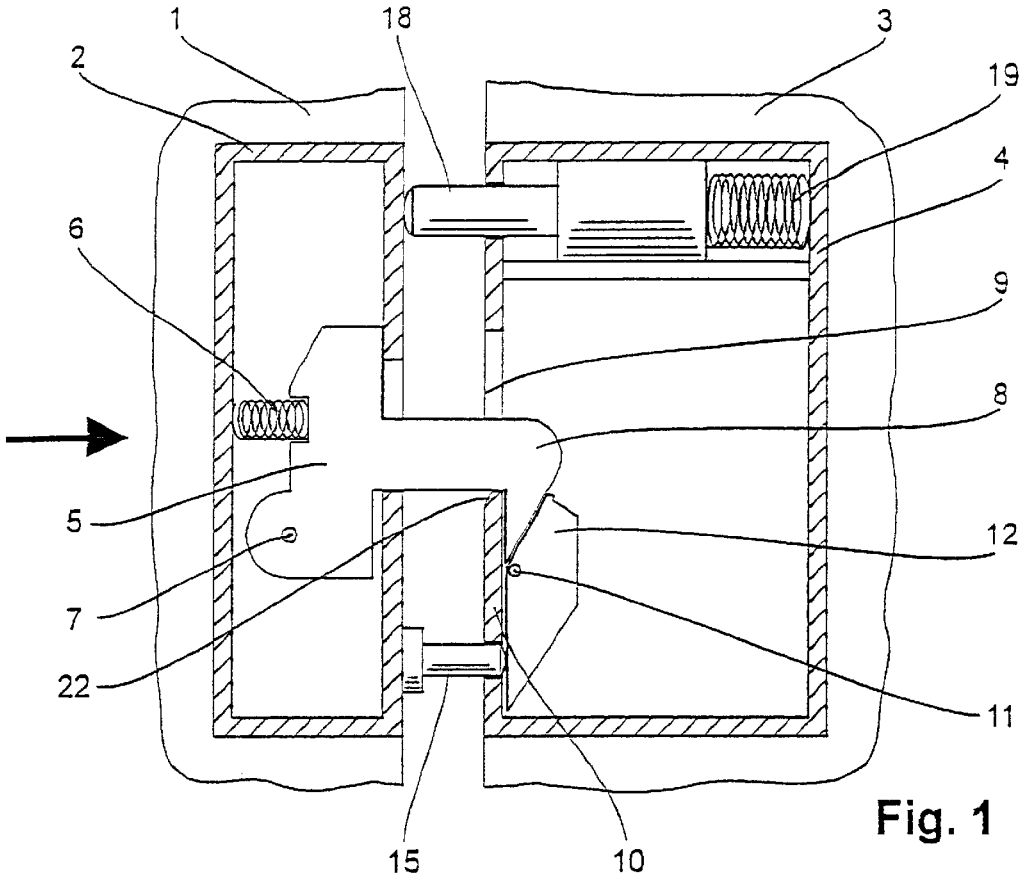
FIG. 1 shows a vertical section through a security lock in accordance with the present invention shown in locked condition at the example of a cupboard door and FIG. 2 shows the same vertical section of FIG. 1, but in unlocked condition of the security lock.

In FIG. 1 on the left-hand side a portion of a cupboard door is shown to which an engagement part 2 of the security lock in accordance with the present invention is fixed, whereas on the right-hand side a portion of a cupboard wall 3 can be seen on or in which a receiving part 4 of said security lock is fixed. Said engagement part 2 as well as said receiving part 4 are built in box shape.

In said engagement part 2 an hook-shaped bolt 5 is pivotably supported at 7 against a pressure spring 6. Said bolt 5 has an head part 8 which in locked position is in clockwise direction engagingly interlocked in a recess 9 of said receiving part 4, namely between an housing-integrated bordering wall 10 serving for locking, of said recess 9 and a cam 12 at 11 pivotably supported in said receiving part 4, which cam comprises diametrically opposing end sections 13 and 14.

Figure 2:
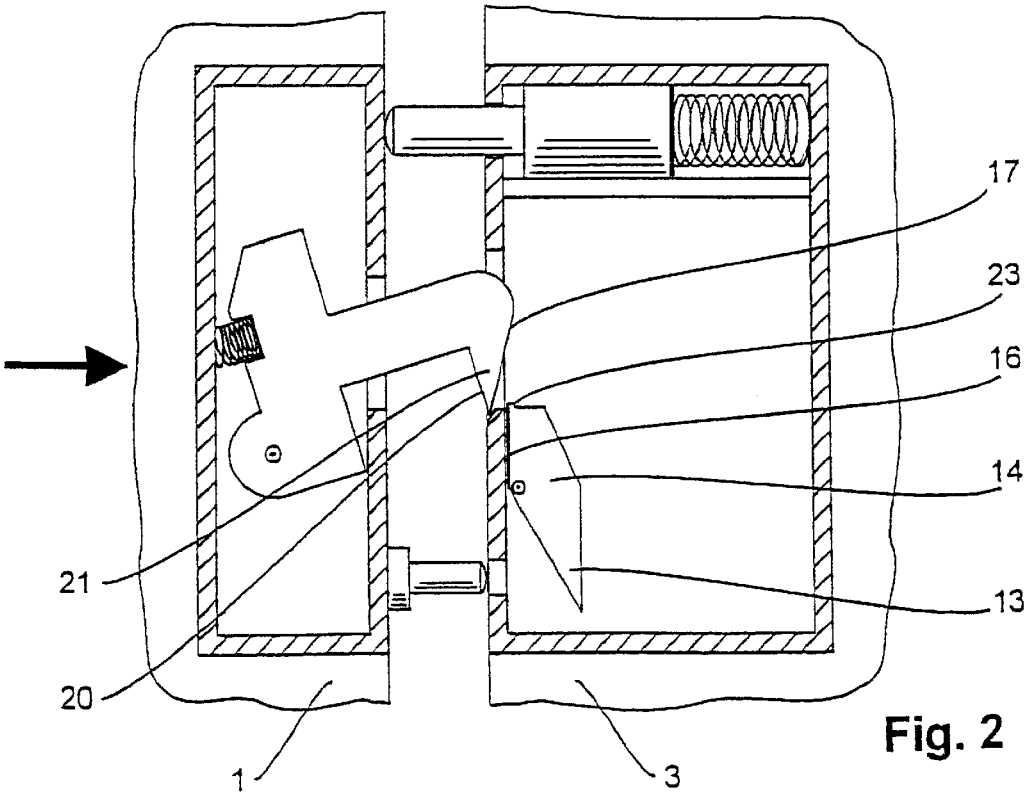

Said end section 13 cooperates with a pin member 15 provided for on said engagement part 2 in such manner that it presses onto the free end section 13 of said cam 12 for intended unlocking, namely when the user presses the closed cupboard door into closed position, said end section 14 being in contact with said head part 8 of said bolt 5 in the manner of two inclined planes 16 and 17 sliding one on the other, of said cam 12 thereby pivoting said head part 8 of said bolt 5 in counterclockwise direction into its unlocked position (FIG. 2).

It is advantageous to provide for at least one element comprimable against a resilient force between said engagement part 2 and said receiving element 4, whereby said head part 8 of said hook-shaped bolt 5 is pressed against said bordering wall 10 with its engaging surface 20 and thus the security lock is kept free of play in its interlocking position, i.e. that it cannot clatter in case of concussions or cannot burst open in case of action of greater forces, e.g. in case of a car accident.

As comprimable element in the shown embodiment a stop pin 18 is provided for which cooperates with a pressure spring 19. Said stop pin 18 disposed in the upper region of said receiving element 4, in the interlocking position shown in FIG. 1 with its free end formed with a spherical rounding bears with spring force on said engagement part 2 and thus presses the engaging surface 20 of said head part 5 to said bordering wall 10.

A similar function for a comprimable element can also be taken over by a sealing, as used e.g. in refrigerator doors. In this case—not shown—the sealing as a rule provided for on the door cooperates with a complementary sealing surface at the refrigerator housing.

As shown in FIGS. 1 and 2, the engaging section referred to by 21 of said hook-shaped head part 8 is built as wedge whose long cross-section corresponds to a rectangular triangle of which the hypotenuse serves as inclined slide plane 17 for said cam 12.

Furthermore, it is advantageous if the housing-integrated bordering wall 10 serving for interlocking said head part 8 of said bolt 8, of said recess 9 is built with an inclination in the run-in area referred to by 22.

In order to permit unlocking of said head part 8 by said cam 12 in simple manner, its upper end section 14 in long cross-section approximately corresponds to that of an unequal truncated pyramid, wherein in unlocked condition the covering surface of said truncated pyramid runs almost in plane with the upper edge of the housing-integrated bordering wall 10, as can be very well seen from FIG. 2. In addition, the shorter pyramid leg forms the inclined plane 16 which cooperates with the corresponding inclined plane 17 of said head part 8.

Using the sharp edge of said head part 8 of said bolt 5, said cam 12 can preferably be moved into its various positions, namely for this reason the covering surface of said cam 12 at the transition to the inclined plane 16 comprises a strip-like shoulder 23 extending in cross direction.

Finally, the end section 13 of said cam 12 in long cross-section is formed as acute triangle and is arranged thus that in interlocked condition (FIG. 1) a cathetus surface extends almost in parallel to the bordering wall 10 of said recess 9 of said receiving member 4. Said end section 13 cooperates with said pin member 15 for intended unlocking of said security lock.

In the following, the functioning of the security lock in accordance with the present invention is explained with reference to the embodiment shown in the drawing.

The following situation is assumed: In case of open cupboard door with the engagement part 2 said hook-shaped bolt 5 is in horizontal released position (not shown, but corresponds to a position like that in FIG. 1) and the stop pin 12 is completely pushed out by the pressure spring 19 (not shown either).

If now the door is manually moved in direction of the arrow shown in FIG. 2, the sharp edge of said head part 8 slides on said inclined run-in area 22 of said bordering wall 10, wherein therein said bolt 5 is simultaneously moved opposite to the force of said pressure spring 6 and said stop pin 18 is slowly inserted opposite to said pressure spring 19. Exactly this situation is shown in FIG. 2.

With a further motion of the door in direction of the arrow, the sharp edge of said head part 8 reaches the strip-like shoulder 23 of said cam 12 and due to this resistance pivots said cam 12 in clockwise direction about the point of rotation 11 and therein simultaneously latches into the wedge-shaped interval becoming free, between said bordering wall 10 and said inclined plane 16 of said cam 12.

This interlocking operation is finished when said head part 8 with its engaging section 21 or the engaging surface 20, respectively, completely bears on said bordering wall 10, wherein simultaneously the two inclined planes 16 of said cam 12 and 17 of said head part 8 come to lie on top of one another. Furthermore, then said pin member 15 with its tip bears on the lower end section 13 of said cam 12 in order to then be capable of immediately transmitting a pressing force onto said cam 12 in case of an intended unlocking. Finally, during the closing operation said stop pin 18 has been pressed further against said pressure spring 19 so that thereby the engaging surface 20 of said bolt 8 is pressed against said bordering wall 10. This interlocked situation is shown in FIG. 1.

If person now wishes to unlock said security lock, it only is necessary to again press the door in direction of the arrow shown in FIG. 1, for this purpose a somewhat greater force being required which is to be rendered more clear by the arrow drawn somewhat larger than that of FIG. 1. The reason lies in that during unlocking said pin member 15 has to pivot said cam 12 opposite to clockwise direction in order that the sliding inclined planes 16 and 178 can press said head part 8 of said bolt 5 upwardly against the pressure spring 6 until the sharp edge of said head part 8 latches over the strip-like shoulder 23 of said cam 12.

If the door is opened completely, the sharp edge of said head part 8 moves out of said receiving member 4 and therein under cooperation of said cam 12 slides in counter-clockwise direction on said upper surface of said cam 12 up to the strip-like shoulder 23 with which said cam 12 then finally is entrained up to the stop to said bordering wall 10, as shown in FIG. 2. Then, the sharp edge of said head part 8 skips over said stop 23 and said security lock again is opened completely.

The fact that for unlocking a greater force is required than for locking provides the advantage that this contributes to the aspect of security, as said security lock just is not to burst open automatically also in case of severe concussions but is to be kept closed.

Even if the invention was explained with reference to an embodiment in form of a cupboard door, the security lock in accordance with the present invention nevertheless also can be successfully also used in other installations/mountings, i.e. e.g. also in a parallel arrangement like a sliding door.

What is claimed is:

1. A security lock, for doors of installations/mountings in caravans in particular, with an engagement part mountable on the doors and a receiving member mountable on the installation which can interlockingly cooperate with said engagement part, characterized in that in said engagement part (2) it comprises a spring-charged pivotable bolt (5) which in case of interlocking interlocks into a recess (9) of said receiving member (4), namely between a housing-integrated bordering wall (10) serving for interlocking, of said recess (9) and a cam (12) pivotably supported in said receiving member (4), with diametrically opposing end sections (13; 14) of which the free end section (13) not facing said head part (8) of said bolt (5) can cooperate with a pin member (15) provided for on said engagement part (2) such that it presses onto the free end section (13) of said cam (8) for intended unlocking, this permitting the end section (14) being in contact with said head part (8) of said bolt (7) in the manner of two inclined planes (16; 17) sliding one on the other, of said cam (12) to pivot said head part (8) of said bolt (5) into an unlocking position.

2. The security lock as defined in claim 1, characterized in that said bolt (5) is built like a hook and is pivotable in clockwise direction into the interlocking position against a spring force (6).

3. The security lock as defined in claim 1, characterized in that at least one element (18) compressible against a resilient force (19) is provided for between said engagement part (2) and said receiving member (4), which can be compressed in interlocking direction against its spring force and thereby exert a pressing force onto said hook-shaped bolt (5) in its interlocking position in the area of its engaging surface (10).

4. The security lock as defined in claim 3, characterized in that said compressible element is a sealing, a door sealing in particular, which can cooperate with a complementary sealing surface.

5. The security lock as defined in claim 3, characterized in that said compressible element is formed as stop pin (18) cooperating with a pressure spring (19).

6. The security lock as defined in claim 1, characterized in that said engaging section (21) of said hook-shaped head part (8) of said bolt (5) is formed as wedge whose long cross-section corresponds to a rectangular triangle of which the hypotenuse serves as inclined sliding plane (17) for said cam (12).

7. The security lock as defined in claim 1, characterized in that said housing-integrated bordering wall (10) serving for interlocking of said head part (8) of said bolt (5), of said recess (9) is inclined in the run-in area (22).

8. The security lock as defined in claim 1, characterized in that said end section (14) coming into contact with said head part (8) of said bolt (5), of said cam (12) in long cross-section approximately corresponds to that of an unequal truncated pyramid, wherein in unlocked condition the covering surface of said truncated pyramid extends approximately in plane with the upper edge of said housing-integrated bordering wall (10) of said recess (9) and the preferably shorter pyramid leg lies within said inclined plane (16) which can cooperate with the corresponding inclined plane (17) of said head part (8).

9. The security lock as defined in claim 8, characterized in that said covering surface of said cam at the transition to the inclined plane (16) has a strip-like shoulder (23) extending in cross direction by which the sharp edge of said head part (8) of said bolt (5) can move said cam (12) in its various positions.

10. The security lock as defined in claim 1, characterized in that said end section (13) cooperating with said pin member (15) for intended unlocking, of said cam (12) in long cross-section is formed as acute triangle and is arranged such that in interlocked condition a cathetus surface extends almost in parallel to said bordering wall (10) of said recess (9) of said receiving member (4).

* * * * *

UNITED STATES PATENT AND TRADEMARK OFFICE

CERTIFICATE OF CORRECTION

PATENT NO. : 6,357,803 B1
DATED : March 19, 2002
INVENTOR(S) : Lorek

It is certified that error appears in the above-identified patent and that said Letters Patent is hereby corrected as shown below:

Column 5,
Line 1, please delete "(7)" and insert therefor -- (5) --.

Signed and Sealed this

Eighteenth Day of June, 2002

*Attest:*

*Attesting Officer*

JAMES E. ROGAN
*Director of the United States Patent and Trademark Office*